United States Patent [19]

Florjancic

[11] Patent Number: 5,061,104

[45] Date of Patent: Oct. 29, 1991

[54] FOLDABLE FLAT BALL POINT PEN

[76] Inventor: Peter Florjancic, Isarstrasse 25, 8109 Wallgau, Fed. Rep. of Germany

[21] Appl. No.: 480,938

[22] Filed: Feb. 16, 1990

[30] Foreign Application Priority Data

Feb. 17, 1989 [DE] Fed. Rep. of Germany ..... 8901868

[51] Int. Cl.[5] ..... B43K 24/02

[52] U.S. Cl. ..... 401/195; 401/99

[58] Field of Search ..... 401/98, 99, 213, 191, 401/247, 102, 195, 52, 6

[56] References Cited

U.S. PATENT DOCUMENTS

| | | | |
|---|---|---|---|
| 1,810,109 | 6/1931 | McEnery | 401/52 |
| 2,039,560 | 5/1936 | Segal | 401/98 |
| 2,370,414 | 2/1945 | Ostrander | 401/191 X |
| 2,675,005 | 4/1954 | Smith | 401/191 X |
| 2,896,576 | 7/1959 | Baer | 401/195 |
| 4,149,812 | 4/1979 | Huffman | 401/99 |
| 4,317,638 | 3/1982 | Klaber | 401/52 X |
| 4,518,273 | 5/1985 | Larizza | 401/213 |
| 4,549,827 | 10/1985 | Mack | 401/109 |
| 4,653,949 | 3/1987 | Larizza | 401/98 |
| 4,872,774 | 10/1989 | Rosso | 401/99 |
| 4,917,519 | 4/1990 | White | 401/99 |

FOREIGN PATENT DOCUMENTS

| | | | |
|---|---|---|---|
| 253218 | 2/1988 | Fed. Rep. of Germany | 401/6 |
| 8200614 | 3/1982 | World Int. Prop. O. | 401/99 |

*Primary Examiner*—Robert A. Hafer
*Assistant Examiner*—Kevin G. Rooney
*Attorney, Agent, or Firm*—Penrose Lucas Albright

[57] ABSTRACT

A flat ball point pen, comprising a cartridge holder part and clasp part, is foldable into a non-writing disposition, wherein one part is pivoted into the other and the two parts define top and bottom surfaces which are flush with each other. In the folded out, or writing disposition, the two parts are firmly connected and have virtually the same length as a standard ball point pen, the clasp part being configured to form a receiving framework for the cartridge holder part, in the form of a closed frame, having two arms joined together at one end and a strut connecting those two arms at the other end. The cartridge holder at its end opposite the writing nib includes a slotted locking member with two walls forming the slot to receive the above mentioned strut, the strut being enclosed between the two walls, with the free ends of the walls ending in facing grooves, which have cleats turned inward. Near the end of the framework, the arms have tongues to receive the grooves when the parts are moved in a relative sense together for locking them together.

18 Claims, 4 Drawing Sheets

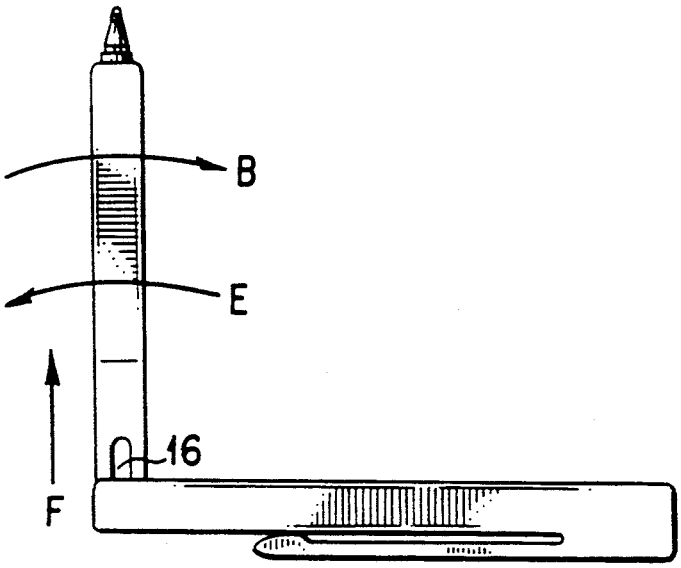
FIG. 6
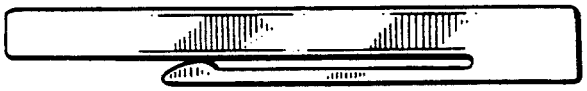
FIG. 7
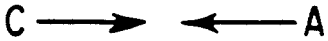
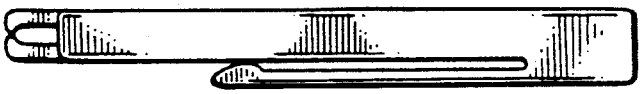
FIG. 7A
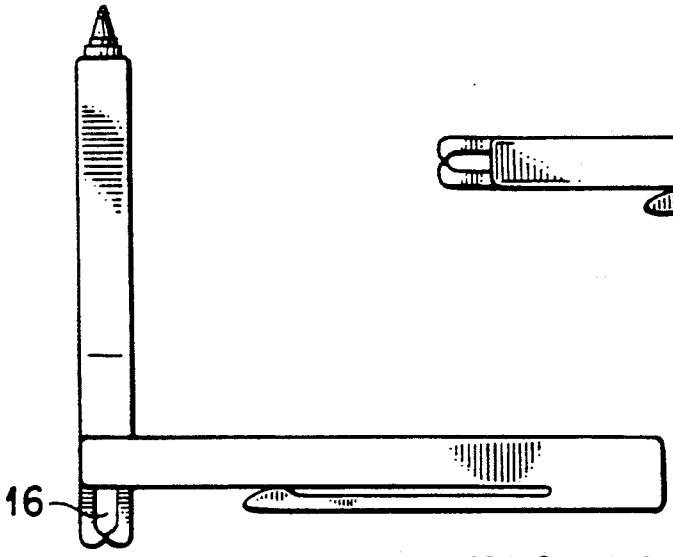
FIG. 6A

FOLDABLE FLAT BALL POINT PEN

FIELD OF THE INVENTION

The present invention relates generally to ball point pens, and more particularly to ball point pens which include a writing or pen part and a clasp or handle part within which the pen part is foldable.

BACKGROUND OF THE INVENTION

In known foldable, flat ball point pens, the rotary axis of the pen is often located in the middle area of one of the parts. This part may be configured as a U-frame, open at one end, which makes the device unstable and inclined to break. Also, as a result, prior art pens when in use, may be quite short when a longer pen, according to the present invention, rests more comfortably in the hand of the writer. The prior art also teaches ball point pens which may be folded in the same manner as a clasp pocket knife which although providing a more usable instrument, tends to be clumsy to carry, particularly in a shirt pocket.

SUMMARY OF THE INVENTION

The present invention is directed to flat ball point pens comprised of two parts, which are joined to be pivotable in relation to one another whereby when not in use, one part encloses and receives the other part, and the pen when folded occupies approximately one half the length it occupied when in its writing disposition while retaining the same thickness whether in the writing or the folded disposition. For writing, the part carrying the ink cartridge is folded out relative to the clasp framework until the two parts lie together linearly in an extended straight line, and each part is firmly engaged, caught, or locked together with the other so the instrument can be used for writing without concern that it will collapse. The pen is rectangular in cross-section and both parts have the same thickness and are along their widths coplanar in either the writing on the folded disposition.

An object of the present invention is to provide a flat pen, having two parts, which is foldable so that when not in use the one part is received within the other part and the two parts together form an article wherein the top and bottom surfaces are flush and compact and the pen tip is protected and enclosed, but in the folded out, or writing disposition, the two parts combine to the length of a standard ball point pen, with the clasp part forming with the pen part a relatively firm extension thereof that fits in the hand of the user in much the same manner as a conventional ball point pen, but with the broader portions thereof between the user's thumb and the metacarpal and first position areas of the index finger.

Other objects, adaptabilities and capabilities of the invention will be appreciated by the skilled in the art as the description progresses, reference being had to the accompanying drawings.

BRIEF DESCRIPTION OF THE DRAWINGS

FIGS. 6 and 6*a* are side views of the ball point pen of FIGS. 1 and 2, which illustrate how it is folded out of writing position into non-writing position and vice versa in two steps.

FIGS. 7 and 7*a* illustrate a further step in the conversion of the invention from its writing to non-writing disposition;

FIGS. 11–13 illustrate in partial section view, which are in an enlarged scale, the locking mechanism of the flat ball point pen in the embodiment of FIGS. 8 and 9 in three different locked and unlocked settings.

DESCRIPTION OF THE PREFERRED EMBODIMENTS

Figure 1:
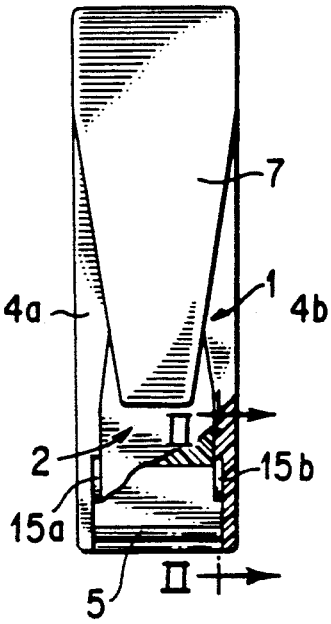
FIG. 1 is a partial cross section view of the ball point pen of the invention in its folded disposition.
Figure 2:
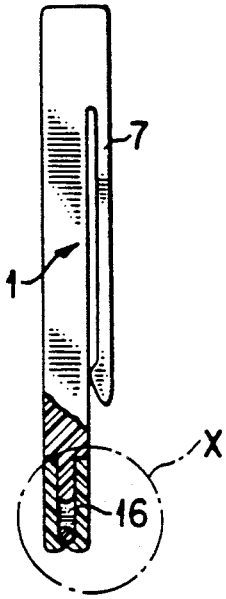
FIG. 2 is a side view of the ball point pen of FIG. 1 also in partial cross section taken on line II–III of FIG. 1.
Figure 3:
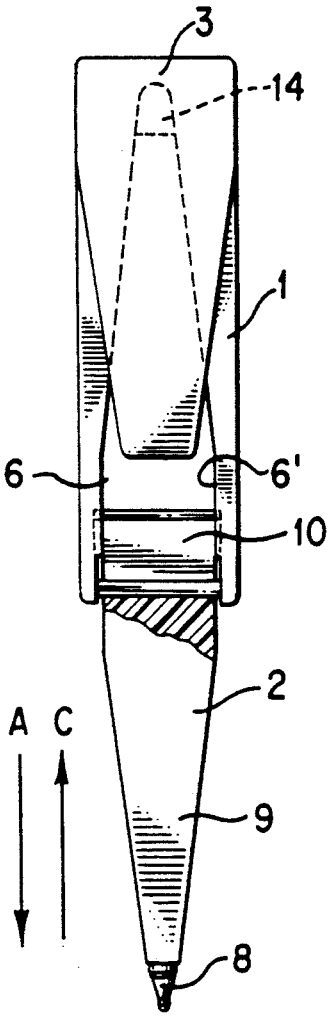
FIG. 3 shows in partial cross section the ball point pen of FIGS. 1 and 2 in its folded out, or writing, disposition, secured in place.
Figure 4:
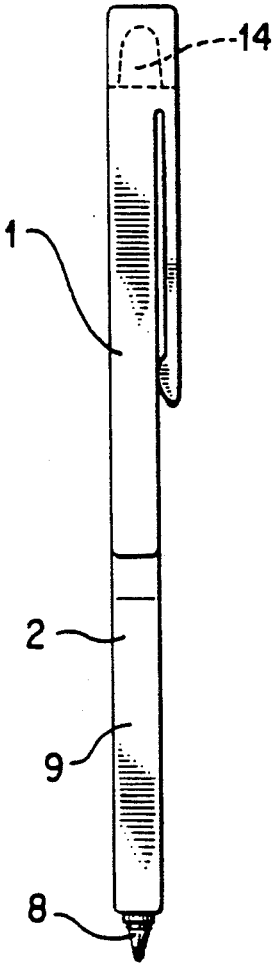
FIG. 4 is side view of the ball point pen illustrated in FIG. 3.

FIGS. 1–5 depict a ball point pen according to the invention in its collapsed, or non-writing disposition (FIGS. 1, 2 and 5), and in its locked, or writing disposition (FIGS. 3 and 4). Its principal parts are the clasp part, which is indicated generally by reference numeral 1, and the ink cartridge holder part which is indicated generally by reference numeral 2.

Clasp part 1 includes two arms 4*a* and 4*b*, joined at an end area 3, which project from end area 3 and receive, in alignment therewith, an ink cartridge holder part 2. Arms 4*a* and 4*b* are joined with each other at the opposite ends by strut 5 which also pivotally receives the ink cartridge holder part 2. In this manner, clasp part 1 forms a closed frame that includes components 4*a*, 3, 4*b*, 5, and thus forms a receiving recess 6 for the ink cartridge holder part 2, when it is collapsed into the non-writing position, into the plane of the framework. For this purpose, the inside contour of the receiving recess 6 is adapted to the shape of the ink cartridge holder part 2 so that when part 2 is folded and received in recess 6 the device, as illustrated in FIGS. 1 and 2, comprises a compact, easily stowable article in which the top surface from which pocket clasp 7 extends, and the bottom surface are parallel with the surfaces of parts 1 and 2 which are flush with each other, as shown in the drawing.

Figure 5:
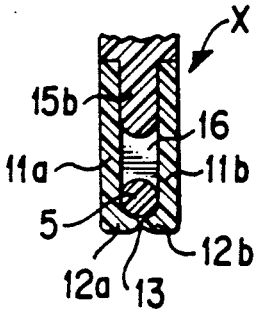
FIG. 5 is a detail in circle "X" of FIG. 2 in enlarged scale.

The ink cartridge holder part 2 is tapered as shown in FIG. 3, to the writing nib 8 so that it is received comfortably by the hand for writing. Its lower tapered area 9 receives the shaft of the ink cartridge in a bore or recess (not shown), whereas its upper end is configured as a securing locking device 10 cooperating with a further cooperating locking means of the clasp part 1. At the end of ink cartridge holder part 2, locking device 10 is gaped or slotted for this purpose as shown in FIGS. 1 and 5, the slot being defined by two walls 11*a* and 11*b* which between them hold the strut 5 which forms a locking means of clasp part 2. The free ends of walls 11*a* and 11*b* terminate in hook-shaped cleats 12*a* and 12*b*, with the hooked ends pointed toward each other in this embodiment. References numeral 13 identifies a slot or groove obtained by beveling the cleats 12*a* and 12*b* for the purpose of forcibly inserting strut 5 of cartridge holder part 2 between walls 11*a* and 11*b* to effect the connection of part 2 to part 1. Thus, when being assembled, the hooked shaped cleats 12*a* and 12*b* are pressed via groove 13 onto strut 5, thereby forcing walls 11*a* and 11*b* apart; they then, having passed over strut 5, snap back into their original position wherein the ends of cleats 12*a* and 12*b* are in contact or almost so.

End area 3 of clasp part 1, contains a recess 14 for enclosing writing nib 8 when the ball point pent is folded down and fitted into its non-writing position.

Frame arms 4*a* and 4*b* are configured to be stepped at their strut ends and at this point to have tongues, protrusions or dogs 15*a* and 15*b*, the thickness of which corresponds to the width of slot 16 of locking device 10, and onto which the ends of walls 11*a* and 11*b* are received axially when securing parts 1 and 2 in their folded or working disposition as explained hereinafter.

For conversion of the ball point pen from the writing disposition shown in FIGS. 3 and 4 into its stowable, foldable disposition as shown in FIGS. 1 and 2, the ink cartridge holder part 2 is entered outwardly via its slot 16 from the dogs 15*a* and 15*b* and clockwise (as seen in FIG. 6) the direction of arrow B as shown in FIG. 6, then moved downwardly to the position shown in FIG. 6*a*. Next, it is pivoted 90° in the direction of arrow B until, as shown in FIG. 7*a*, ink cartridge holder part 2 lies in the same plane as clasp part 1 in the direction of arrow C until the writing nib 8 of the ink cartridge is received in recess 14 as shown in FIG. 7.

Reversing this procedure, that is, unfolding the ink cartridge holder part 2 out of clasp part 1, to the pen is in its writing position, first the ink cartridge holder 2 is withdrawn from the clasp part 1 in the direction of arrow A and then pivoted 90° in the direction of the arrow E. Next, it is drawn upwardly in the direction of arrow F, then it is pivoted another 90° in direction of arrow E and thereafter again inserted in the direction of arrow C into the clasp part 1, until its walls 11*a* and 11*b* are received over dogs 15*a* and 15*b*, thereby firmly fastening parts 1 and 2 together for use of the ball point pen.

In the further embodiment depicted in FIGS. 8–14, the principal parts of the flat ball point in accordance with the invention are substantially the same as those of FIGS. 1–7, the invention thus comprising a clasp member 100 and an ink cartridge holder part 200, which are similar to parts 1 and 2 described above. In this embodiment, however, for reasons related to the extrusion technology used in forming the device of a plastic material and also to provide an improved assembly, both clasp member part 100 and the ink cartridge holder part 200 are initially comprised of two parts.

Figure 9:
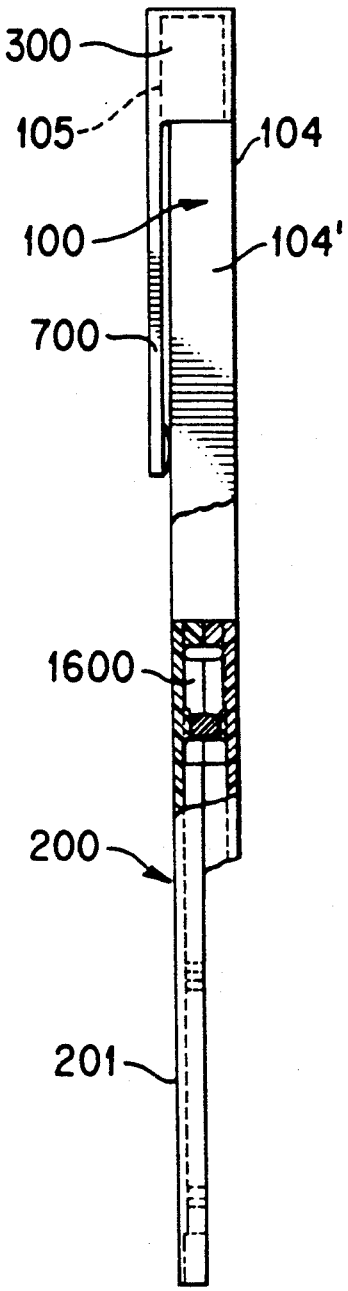
FIG. 9 is a side view of the embodiment shown in FIG. 8.

In this embodiment, clasp part 100 comprises a framework 101 and an end cap 102. Framework 101 has two arms, 400*a* and 400*b*, which are joined at an end area 300 and a strut 500 connects the two free ends of the arms 400*a* and 400*b*. End area 300 of framework 202, in which recess 1400 is formed for the writing nib, is configured to be stepped inwardly on all sides as seen in FIG. 9, so that it fits precisely, snugly and rigidly in the inside surface 103 of cap 102. Cap 102 can therefore be mounted thereon and permanently affixed to framework 101, and include a clasp member 100 together with end area 300 so that the top surface 104 and side surface 104' of the cap and framework extend so that they are flush with each other.

The inside wall 105 of cap 102 is preferably lengthened along its entire width to form the pocket clasp 700. It can be integral with or affixed to the remains of cap 102.

Ink cartridge holder part 200 also comprises two parts, shown as halves 201. One half is removed in FIGS. 8 and 9, so only the other half is visible in FIG. 8 and partially shown in FIG. 9. The ink cartridge holder part 200 is arranged so that the halves 201 are essentially identical and are permanently and rigidly connected together by, for instance, ultrasonic welding.

Figure 10:
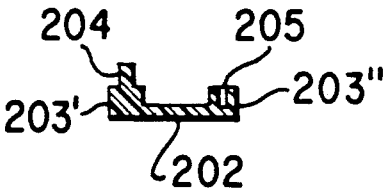
FIG. 10 is a cross section through the invention as shown in FIG. 8, taken on line X—X of FIG. 8.

Each half 201 consists of a flat relatively broad wall 202 and two narrower side walls 203' and 203'', one of them being provided with a plurality of centering pins 204 and the other with corresponding centering bores 205 as shown in FIG. 10. The side walls 203' and 203'' extend together at their lower aspect 206 at each to form an ink cartridge point receiver 207. Here, the joined halves 201 define an outer periphery which is virtually a square as seen end-on and on inner bore which is vertically a circle seen from the same perspective.

Figure 8:
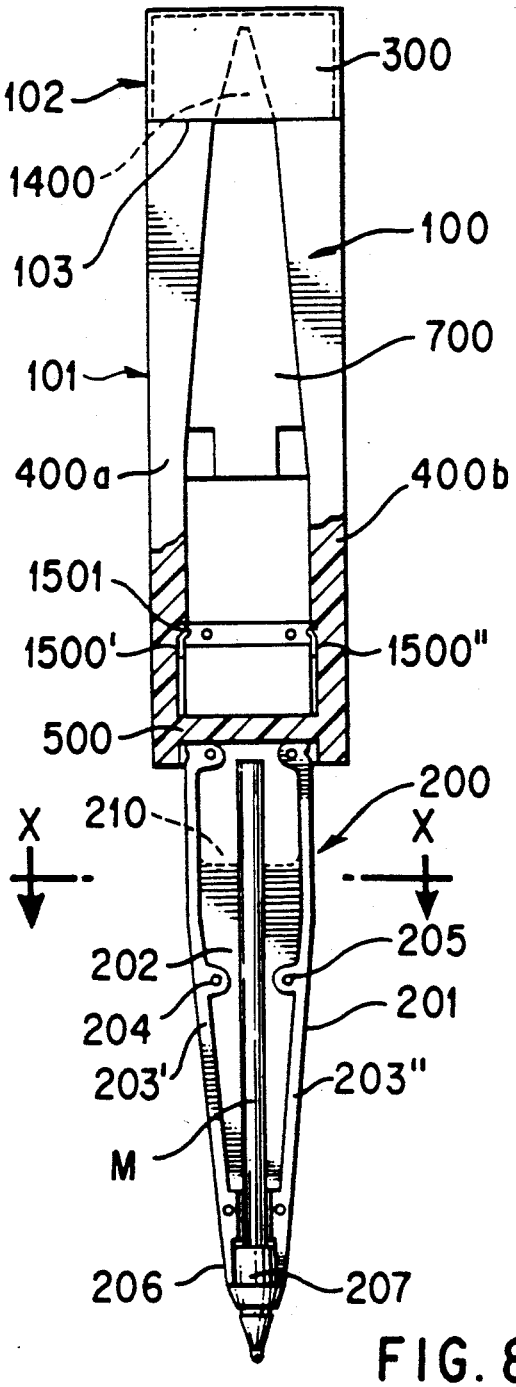
FIG. 8 is a view in partial cross section of a further embodiment of the invention in larger scale.
Figure 13:
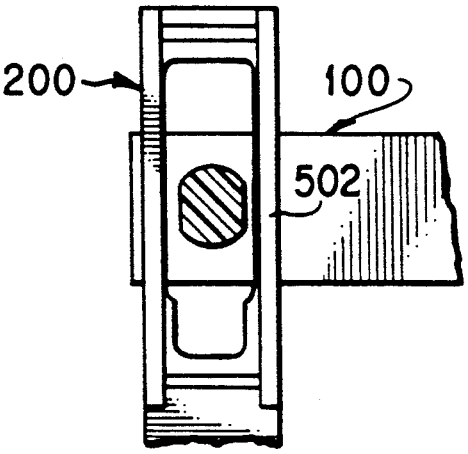

For joining of the two halves 201 to form ink cartridge holder part 200, strut 500 of clasp part 100 is disposed at the upper aspect of one of halves 201 of cartridge holder part 200 as seen in FIG. 8. Then the other half 201 is superimposed thereon so that centering pins 204 are received into centering bores 205. The two halves are next connected with each other, for instance by application of adhesive or by ultrasonic welding, so that single unit ink cartridge holder part 200 is formed, as shown in FIGS. 9 and 13, whereby the ink cartridge M is snugly received in the bore within the lower aspect 206 of part 200. However, ink cartridge M can be inserted after halves 201 have been secured together, if desired.

Figures 14, 14A:
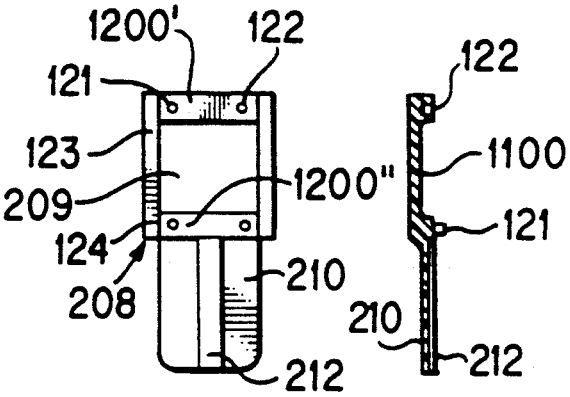
FIGS. 14 and 14*a* illustrate a locking member for the pen shown in FIGS. 8 and 9 in front and side views, using the same scale as FIGS. 8 and 9.

Ink cartridge holder part 200 as shown in FIG. 8 includes an ink cartridge receiving framework and a separate locking device designated generally by reference numeral 208. Referring to FIG. 14, in this embodiment, locking member 208 comprises two protective halves. After two halves of device 208 are joined to receive strut 500 of clasp part 100 between them, they are permanently fastened together by ultrasonic welding or other suitable connecting means. Each half of device 208 includes a gapped or slotted locking member 209 with walls 1200' and 1200'' and an engaging plug or tongue member 210. Centering pins 121 project from one side of walls 1200' and 1200'' and corresponding centering bores 122 are provided on the other side. The halves of locking device 208, when connected with one another via pins 121 and bores 122, enclose strut 500 between them, and thus form slot 1600 and extensions or tongue members 210, on which are mounted the assembled ink cartridge holder part 101 in the manner shown in broken lines in FIG. 8. Also, the upper aspect of ink cartridge M is held tightly in conforming grooves 212 formed in tongue members 210, whereas its lower aspect is received tightly by the ink cartridge point retainer 207.

Outwardly extending ridges or lips 1500' and 1500'' into which the rear lateral slots formed by the surfaces 123 in device 208 slide when parts 100 and 200 are moved into their writing or folded dispositions, are located inside and near the ends of the framework arms 400*a* and 400*b*. They present cam surfaces 1501 which engage in the secured dispositions of parts 100 and 200, detents which are formed in, on the surfaces immediately above, walls or strips 1200' and 1200''. The lower ends of the lateral slot formed between surfaces 123 slide into the locked position receiving strut 500 firmly, although slideably.

Figure 12:
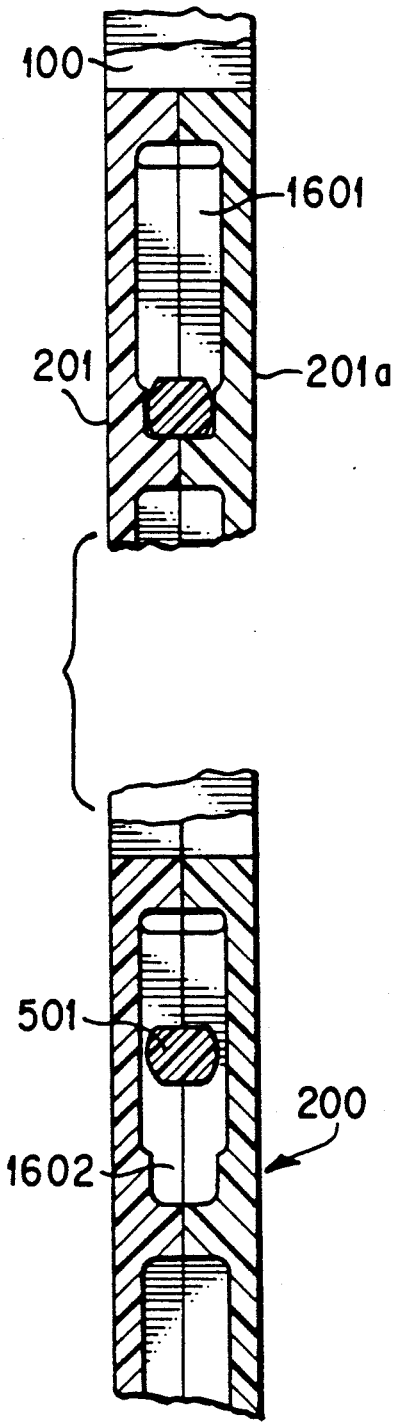

In a yet further embodiment, as shown in FIGS. 11–13, the two halves 201 and **201*a* of the ink cartridge holder part 200 forming the locking device are configured so that they form a gap or slot 1601 which, as seen in the locked position of FIG. 11, forms a pocket 1602 (see FIG. 12) of smaller width at one end of the slot, and the diameter of the further embodied clamp member strut 501 is dimensional so as closely to match the width of pocket 1602; thus, when the pen is in its unfolded, or writing disposition, a particularly rigid construct is achieved by the inter actions of ridges or lips 1500' and 1500'' on the one hand and by strut 501 on the other hand with slot 1601, including pocket 1602. When the ink cartridge holder part 200 is pulled down (in the direction of arrow A, referring to FIG. 3 of the previous embodiment) as shown in FIG. 12, this arrangement provides space between strut 501 and the slot forming walls 1100 of member 208 of the ink cartridge holder part 200 which permits strut 501 to move more freely within slot 1600. Moreover, the spaced relationship is employed to avoid any heat transmission to the strut when the halves of device 208 (or parts 201 and 201*a* if such halves are incorporated therein) are joined by ultrasonic welding; it also provides easier cementing of strut 501 to arms 400*a* and 400*b***.

When the ink cartridge holder part 200 is withdrawn relative to the clasp part 100, the pivoting of one such part relative to the other is necessary. This then is further facilitated and improved if strut 501 is flattened on its two opposite sides, as illustrated in FIG. 13, and prevents frictional jamming of parts 100 and 200 in their intermediate positions, e.g. as shown in FIGS. 6 and **6*a*. When the ink cartridge holder part 200 is moved from a locked disposition with clasp part 100, which is horizontal or almost horizontal, part 200 drops automatically as seen in FIG. 13** to a perpendicular position.

Although I have described the preferred embodiments of my invention, it is to be understood that it is capable of other adaptions and modifications within the scope of the following claims.

Having disclosed my invention, what I claim as new and to be secured by Letters Patent of the United States is:

1. A flat, ball point pen comprising an ink cartridge part and a clasp part which can be pivoted relative to one another so that in a non-writing disposition, the ink cartridge part is folded into the clasp part and for the writing disposition, the ink cartridge part is pivoted 180° relative to the clasp part and forms an extension thereof, wherein the clasp part is configured as a receiving framework for the ink cartridge part, said clasp part comprising arms joined in an outer end area and a strut connecting said arms at their free ends, said ink cartridge part comprising a slotted locking device at one end and a writing nib at the other, the locking device comprising spaced apart walls forming a slot that receives said strut, said walls and said arms defining and being selectively rigidly connectable by tongue and groove means which perform the function of retaining said ink cartridge part and said clasp part rigidly together when in said writing disposition and when in said folded disposition and being disengaged by linear movement of said parts relative to each other so they can be pivoted from one said disposition to the other said disposition.

2. A ball point pen in accordance with claim 1, wherein said ink cartridge part tapers to said writing nib and said receiving framework in the clasp part having a corresponding inside contour.

3. A ball point pen in accordance with claim 1, wherein at the end area of said clasp part, said receiving framework for said ink cartridge part extends into a recess in said clasp part to receive said writing nib of the ink cartridge part when in the folded disposition.

4. A ball point pen in accordance with claim 1 wherein said clasp part comprises a cup-shaped cap which is affixed to and receives a further end area of said framework which is opposite said outer end area.

5. A ball point pen in accordance with claim 4 wherein a position of said cap is extended to form a pocket clasp.

6. A ball point pen in accordance with claim 1 wherein said ink cartridge part comprises two protective covering members which are secured tightly with one another after receiving said strut in said slot.

7. A ball point pen in accordance with claim 6 wherein said slot formed in said locking device inward of said outer end area is configured to include a pocket having a smaller width between said walls than in the remainder of said slot and said engaging strut having a diameter that closely corresponds to said smaller width of said pocket.

8. A ball point pen in accordance with claim 6 wherein said ink cartridge part comprises means for securing an ink cartridge therein, said securing means comprising two half members which define a bore for holding said ink cartridge when said half member are coupled together in said ink cartridge part.

9. A ball point pen in accordance with claim 8 wherein said two half members are substantially identical and include said walls that define said slot and receive said strut.

10. A ball point pen in accordance with claim 8 wherein said two half members also define in part said tongue and groove means.

11. A ball point pen in accordance with claim 1 wherein said strut is circular in cross section except that segments are removed therefrom on opposite sides to create areas which are closer together than the diameter otherwise of the strut, such areas being substantially bisected by the longitudinal center line of said clasp part.

12. A ball point pen in accordance with claim 1 wherein said locking device includes cams mounted on the sides of said arms of said clasp part near the free ends of said arms, said cams extending toward each other and being constructed and arranged to interact with said ink cartridge part to retain same rigidly, but releasably, in relation to said clasp part in said writing disposition.

13. A ball point pen in accordance with claim 1 wherein said clasp part has a width which is substantially three times its thickness.

14. A ball point pen in accordance with claim 13 wherein said width is about three-fourths of an inch and said thickness is about one-fourth of an inch.

15. A ball point pen in accordance with claim 14 wherein said ink cartridge part has a width of about nine-sixteenths of an inch and a thickness of about one-fourth of an inch.

16. A ball point pen in accordance with claim 15 which has an overall length of about five and one-half inches in its writing disposition.

17. A ball point pen in accordance with claim 16 which has an overall length of about three inches in its folded disposition.

18. A ball point pen in accordance with claim 1 wherein said tongue and groove means comprises groves defined by said walls and tongues provided to cooperate therewith extending inwardly from the ends of said arms, said tongues being disposed inwardly relative to said outer end area.

* * * * *